US005713662A

United States Patent [19]

Kira

[11] Patent Number: 5,713,662

[45] Date of Patent: Feb. 3, 1998

[54] ADJUSTABLE LAMP FIXTURE WITH OFFSET CLAMP

[75] Inventor: Hiroshi Kira, Westlake Village, Calif.

[73] Assignee: Lumiere Design & Manufacturing, Inc., Westlake Village, Calif.

[21] Appl. No.: 694,349

[22] Filed: Aug. 7, 1996

[51] Int. Cl.[6] ..... F21M 3/18

[52] U.S. Cl. ..... 362/427; 362/269; 362/287

[58] Field of Search ..... 362/269, 287, 362/370, 371, 427, 432, 285, 396

[56] References Cited

U.S. PATENT DOCUMENTS

| | | | |
|---|---|---|---|
| 1,865,928 | 7/1932 | Vigne et al. | 362/269 |
| 4,974,135 | 11/1990 | Wen-tsung | 362/427 |

*Primary Examiner*—Y. My Quach

*Attorney, Agent, or Firm*—Wagner & Middlebrook

[57] ABSTRACT

An adjustable angle lamp fixture is disclosed including a housing with a pair of annular oppositely disposed surfaces with a wireway therethrough. A pair of hat shaped members each face a respective annular surface on the housing. A pair of arms bias the hat shaped members against the annular surface on the housing. The housing may rotate about an axis defined by the hat shaped members with the wires for a lamp contained within the housing extending from a base to the housing without restriction within the range of angular rotation.

18 Claims, 3 Drawing Sheets

FIG. 1
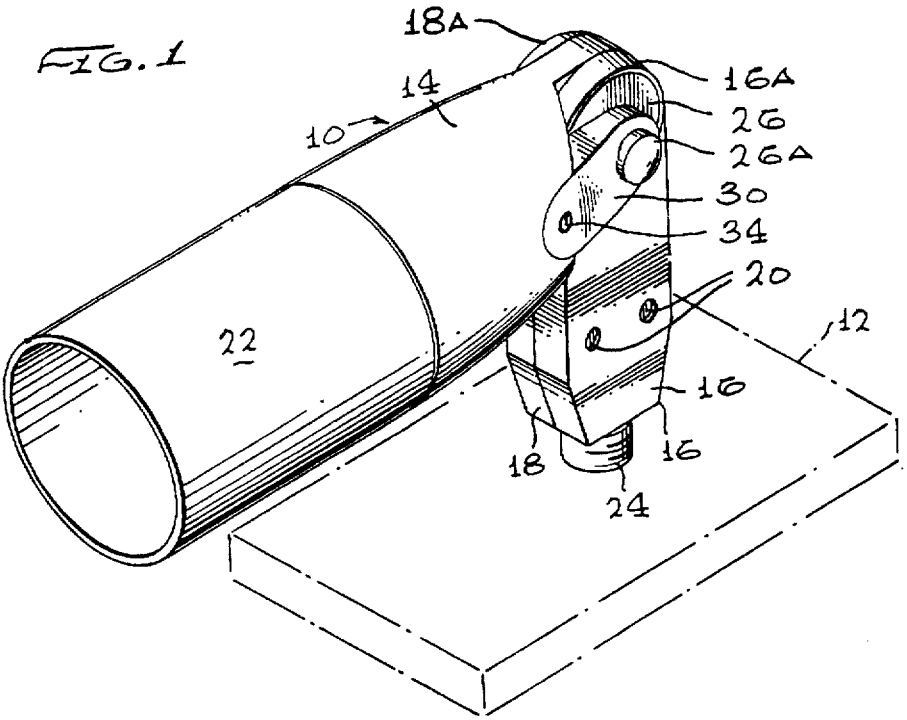
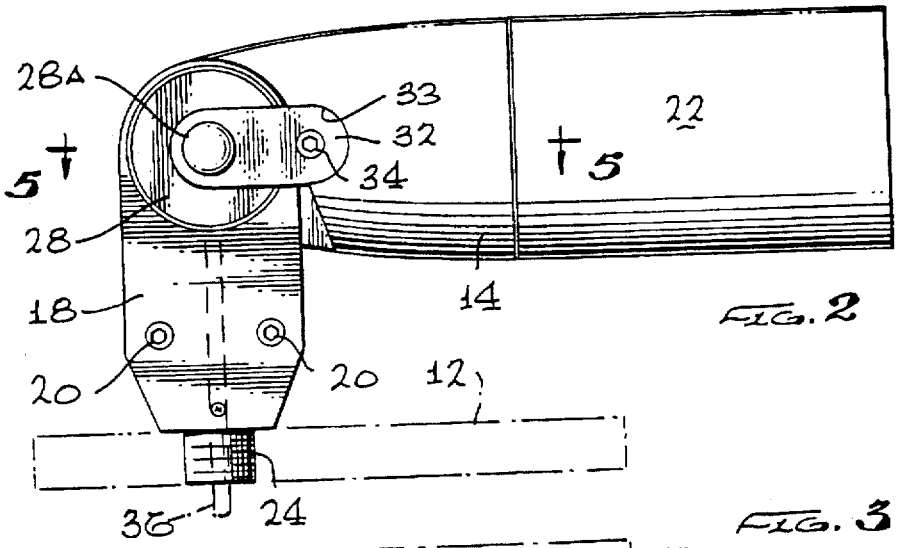
FIG. 2
FIG. 3
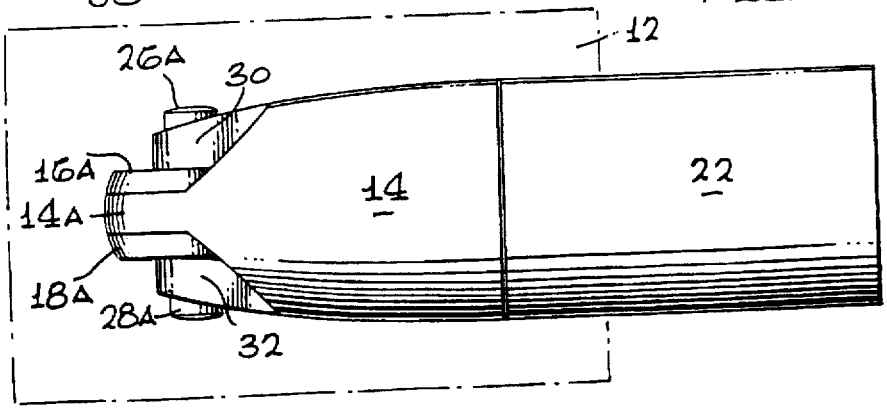

34
32
28
22
18A
18B
14
14A
35
56
60
16A
16B
26
46
54
62
58
64
18
30
16
14A
16A
18A
26A
28A
30
32
14

16
18
24

ADJUSTABLE LAMP FIXTURE WITH OFFSET CLAMP

BACKGROUND OF THE INVENTION

There have been many lamp designs which, in one way or another, incorporate some sort of pivot structure to make it possible to direct the light at many different angles. Some attempt to avoid running the wiring through a pivot mechanism by leaving the wires exposed and subject to flexing upon adjustment. This is, in general, unacceptable for outdoor lighting fixtures and is unsightly at best. Others provide a pivot structure which conceals the wiring, but may be bulky and unattractive. There appears to be a continued need for a lighting fixture for indoor or outdoor use which conceals the wiring, which has a simple good performing pivot structure, which may be mounted in almost any position, which is pleasing in appearance and relatively inexpensive to produce.

SUMMARY OF THE INVENTION

The lamp fixture of the present invention includes a generally cylindrical lamp housing having a narrower pivot portion at one end with oppositely disposed parallel generally annular faces and a space for receiving electrical wires directed to the inside of the housing. The housing is pivotally supported on a base including a pair of facing mirror image support members which are connected together and each of which includes a narrowed end section with parallel annular faces on each side. The inside annular face of each end section is positioned adjacent one of the annular faces of the lamp housing.

Adjacent the other annular face of each end section is a hat-shaped member having a circular face and an upstanding cylindrical part. A cut out area along each side of the lamp housing adjacent its narrow pivot portion receives an elongated pivot arm having on one end a cylindrical bore receiving one of the upstanding cylindrical parts of the hat-shaped member and at the other end a port receiving a screw for fastening the pivot arm to the lamp housing. The angle of the lamp housing with respect to the base is established by loosening the screw through the pivot arms to release the force of the hat-shaped members against the support members and the lamp housing after which the lamp housing is moved to a desired angle. The screw may then be tightened to secure the lamp housing at the desired angle.

The base includes a threaded collar for fastening the lamp fixture to other supports as desired. Electrical wires are supplied through the collar and through the base to openings in the narrowed end sections of the support members and from there to a space in the pivot portion of the lamp housing which communicates with the interior of the lamp housing for connection to a lamp.

One feature of this invention resides in the fact that the lamp housing is adjustable 360° in azimuth and over a horizontal axis continuously over a selected angle without any serrations or other incremental adjustment limitations.

Another feature of this invention involves such freedom of adjustment with secure locking after adjustment.

One further feature involves a virtually unrestricted wireway path through the adjustment mechanism.

Still another feature places the locking mechanism totally clear of the wireway path.

Incorporating all of these features, the adjustment mechanism does not detract from the beauty of the fixture.

BRIEF DESCRIPTION OF THE DRAWINGS

This invention may be more clearly understood with the following detailed description and by reference to the drawings in which:

FIG. 1 is a perspective view of a lamp fixture according to my invention;

FIG. 2 is a side elevational view of the lamp fixture of FIG. 1

FIG. 3 is a top plan view of the lamp fixture of FIG. 1;

DESCRIPTION OF THE PREFERRED EMBODIMENT

Figure 6:
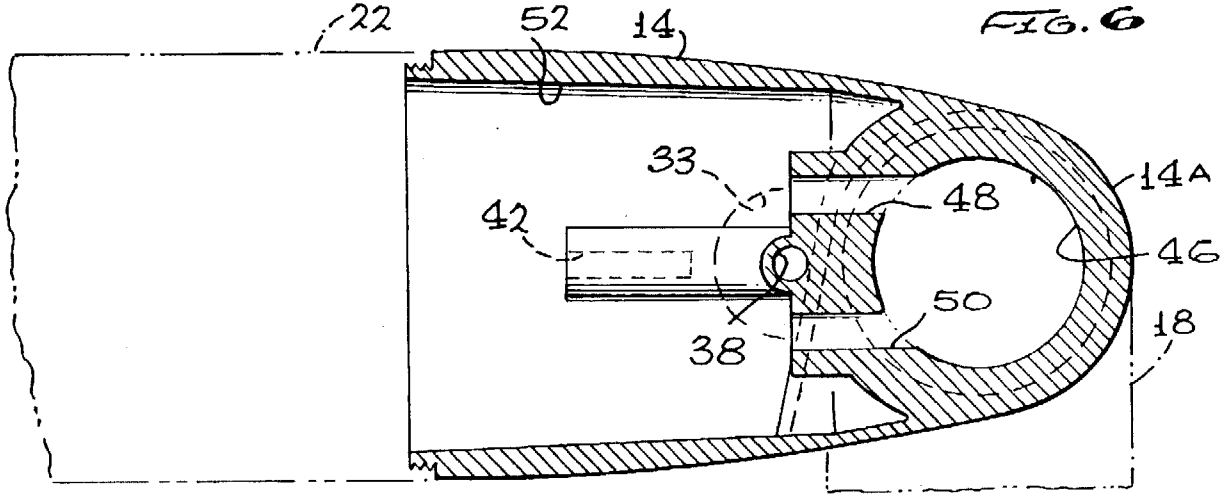
FIG. 6 is a sectional view taken along line 6—6 of FIG. 5.

Referring now to FIG. 1, the lamp fixture of the invention is shown generally designated 10 mounted on any electrical lead supplying surface here represented as a mounting board 12. The lamp fixture 10 includes a lamp housing 14 supported on a base including a pair of essentially mirror image support members 16 and 18 which are fastened together by means of screws 20. Lamp housing 14 includes a cylindrical extension 22 threadedly engaged with housing 14. Threaded nipple 24 provides a means of attachment of lamp fixture 10 to mounting board 12 shown in phantom. The threaded nipple 24 may be formed in halves with support members 16 and 18 or may be separate and threadedly engaged with members 16 and 18.

One end of housing 14 is narrowed to provide a flange 14A which is part of a pivot structure including end parts 16A and 18A of support members 16 and 18. Flange 14A includes oppositely directed annular faces which adjoin similar annular faces on the inside surfaces of end parts 16A and 18A. End parts 16A and 18A also have outside annular faces which adjoin circular faces on a pair of hat-shaped pivot members 26 and 28 (of which only member 26 is visible in FIG. 1). Set into a cut-out area of housing 14 and surrounding an upstanding cylindrical part 26A of pivot member 26 is a pivot arm 30. A similar pivot arm 32 is unshown in FIG. 1 but may best be seen in FIGS. 2 and 7.

FIG. 2 is a side elevational view of the lamp fixture of FIG. 1 but showing the opposite side which is almost identical. In this view are shown lamp housing 14 with cylindrical extension 22, support member 18, hat-shaped pivot member 28 and pivot arm 32. Pivot arm 32 is positioned in a cut out 33 in the side of housing 14 and includes a bore surrounding cylindrical part 28A and a smaller bore for receiving a screw 34 which secures pivot arm 32 to housing 14. Also shown in this view are the heads of screws 20 which hold support members 16 and 18 together. Threaded nipple 24 receives electrical wires 36 from the mounting board 12 for energizing a lamp, not shown, in housing 14. Any of a number of types of suitable lamps may be installed in housing 14. Wires 36 are fed through the hollow interior of the base formed by support members 16 and 18.

FIG. 3 is a top view of the lamp fixture of FIGS. 1 and 2. In this view are shown housing 14 with end flange 14A, cylindrical extension 22, end parts 16A and 18A of support members 16 and 18, the cylindrical parts 26A and 28A of pivot members 26 and 28 and pivot arms 30 and 32.

Figures 4, 7:
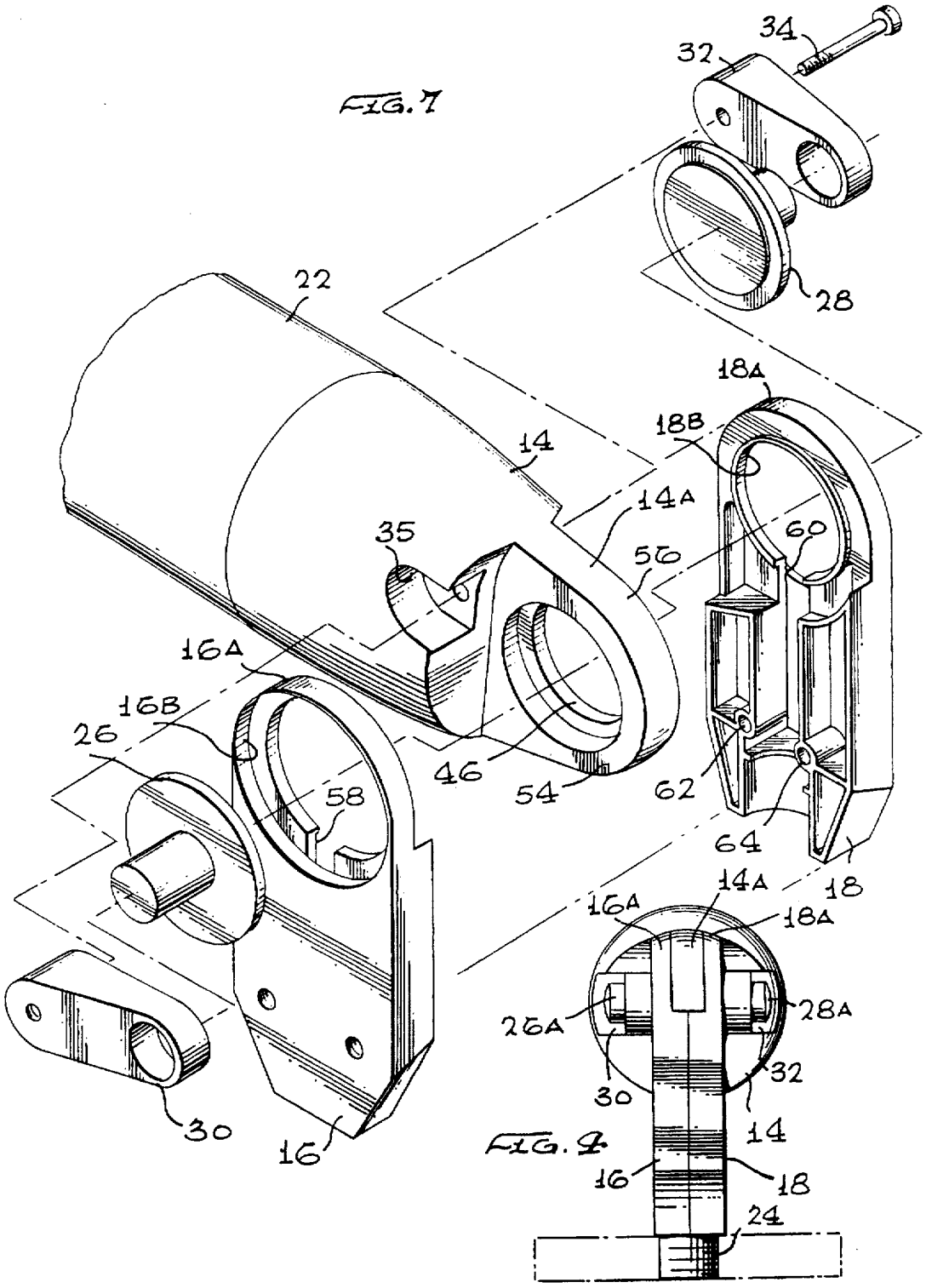
FIG. 4 is a rear elevational view of the lamp fixture of FIG. 1.
FIG. 7 is an exploded view of the lamp fixture of FIG. 1.

FIG. 4 is rear elevational view of the lamp fixture 10 showing housing 14 with end flange 14A, support members 16 and 18 with end parts 16A and 18A, cylindrical parts 26A and 26B of pivot members 26 and 28, pivot arms 30 and 32, and threaded nipple 24.

Figure 5:
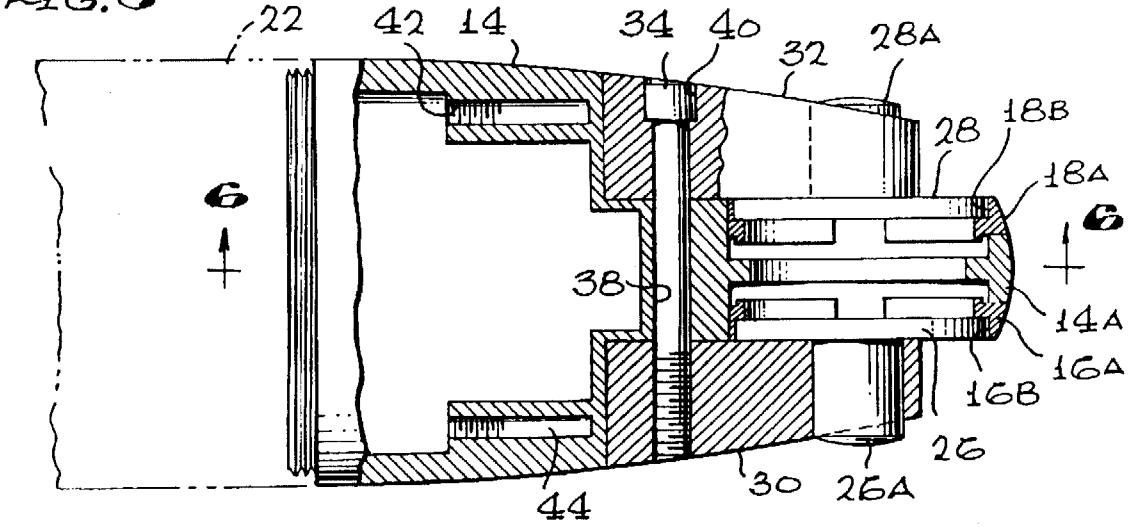
FIG. 5 is a sectional view taken along line 5—5 of FIG. 2.

FIG. 5 is a partial sectional view taken along line 5—5 of FIG. 2. This view shows most of housing 14 in section including flange 14A. In this view a broken away part of cylindrical extension 22 is shown in phantom threadedly engaged with housing 14. Also shown in section are end parts 16A and 18A of support members 16 and 18 which are held in facing engagement with annular surfaces on the opposite sides of flange 14A. Hat-shaped pivot members 26 and 28 each has a large diameter rim portion with a circular face set into shallow circular bores 16B and 18B of end parts 16A and 16B and are held against the outside annular faces of end parts 16A and 18A, respectively. The hat-shaped members 26 and 28 are of importance in that they define the pivot axis and provide frictional surfaces for universal angular adjustment.

The pivot arms 30 and 32 are shown each with a large bore at one end surrounding cylindrical parts 26A and 28A of the hat-shaped members 26 and 28. At the opposite ends of pivot arms 30 and 32 are smaller diameter bores aligned with a similar bore 38 drilled through lamp housing 14. Screw 34 is positioned in these aligned bores of which the bore in pivot arm 30 is threadedly engaged with threads on screw 34 and the bore in pivot arm 32 is smooth but includes a counterbore 40 creating a larger diameter cylindrical opening and a shoulder to accommodate the head of screw 34.

Lamp housing 14 also includes internal threaded bores 42 and 44 which accommodate fasteners used to secure a lamp.

FIG. 6 is a sectional view taken along line 6—6 of FIG. 5. This view shows lamp housing 14 and flange 14A. Flange 14A includes a large diameter opening 46 which communicates through ports 48 and/or 50 with the inside cylindrical chamber 52 of lamp housing 14 to provide passageways for wires to reach chamber 52.

It should be noted that this large diameter opening allows for a gentle bonding of any wires extending from the support to the lamp housing—totally clear of any fastening, locking fasteners.

FIG. 7 is an exploded view of the lamp fixture of the invention with the mounting board 12 and the threaded nipple 24 deleted. Flange 14A of lamp housing 14 has parallel annular faces 54 and 56. Opening 46 is shown with ports 48 and 50 which communicate with chamber 52 in lamp housing 14. Support members 16 and 18 have end parts 16A and 18A which have annular faces on both sides. The inside annular faces of end parts 16A and 18A face against surfaces 54 and 56 of flange 14A. The outside annular faces of end parts 16A and 18A are at the bottom of shallow bores 16B and 18B which bores receive the large diameter portions of pivot members 26 and 28, respectively. At the lower edge of each of bores 16B and 18B are notches or openings 58 and 60, respectively, which notches provide openings for electrical wires to pass from the inside of support members 16 and 18 into opening 46 and then through ports 48 and 50 into the lamp housing 14. Large opening 46 provides clearance for the wires of the fixture without restriction on them during adjustment or when in service. The pivot arms 30 and 32 are shown surrounding the cylindrical extensions 26A and 28A as described and also as being seated in cut-outs 33 and 35 of lamp housing 14. In FIG. 7, only cut out 35 is visible. Each of support members 16 and 18 include bosses for receiving screws 20 (See FIG. 1), but only bosses 62 and 64 are visible in support member 18.

When the lamp fixture 10 is assembled, the pivot members 26 and 28 are held against the bottom faces of bores 16B and 18B which presses end parts 16A and 18A against faces 54 and 56. By tightening screw 34, the pivot arms 30 and 32 press all the described surfaces together, thus holding lamp housing 14 at a desired angle relative to support members 16 and 18. Direct functional engagement is sufficient to hold the lamp housing in the precise angle selected. When it is desired to direct the lamp fixture at a different angle screw 34 is loosened, thereby reducing the pressure of pivot arms 30 and 32 against pivot members 26 and 28, thereby permitting lamp housing 14 to be rotated at least 110° degrees relative to support members 16 and 18. The screw 34 is totally remote from the wires servicing the lamp in housing 14.

The above described embodiments of the present invention are merely descriptive of its principles and are not to be considered limiting. The scope of the present invention instead shall be determined from the scope of the following claims including their equivalents.

What is claimed is:

1. An adjustable lamp fixture comprising a lamp housing, a base and pivot means connecting said base to said housing, said base defining a pair of hollow support member;

said pivot means comprising a narrow part at one end of said lamp housing having parallel generally annular faces on opposite sides thereof, said hollow support members including forming parts of said base straddling said narrow part, each of said hollow support members having parallel annular faces on opposite sides thereof, one of said annular faces being associated with and in facing relationship with one of said generally annular faces of said narrow part, a pair of hat-shaped pivot members each having a flat circular face associated with and in facing relationship with another of said parallel annular faces of each of said support members, each of said pivot members also including an upstanding cylindrical portion, a cut-out area along each side of said housing adjoining said narrow part, a pair of elongated pivot arms each having a generally cylindrical bore through one end surrounding said upstanding cylindrical portion and having its opposite end positioned in said cut-out area, and fastener means in said opposite end securing said pivot arms to said lamp housing.

2. An adjustable lamp fixture as claimed in claim 1 wherein said support members include a pair of shallow cylindrical wells respectively receiving one of said pivot members.

3. An adjustable lamp fixture as claimed in claim 1 wherein each end of each of said pivot arms is semi-cylindrical and each said cut-out area includes a mating semi-cylindrical surface.

4. An adjustable lamp fixture as claimed in claim 2 wherein each end of each of said pivot arms is semi-cylindrical and each said cut-out area includes a mating semi-cylindrical surface.

5. An adjustable lamp fixture as claimed in claim 1 wherein said generally cylindrical bores are slightly tapered.

6. An adjustable lamp fixture as claimed in claim 1 wherein said base includes fastening means and said fastening means includes an opening receiving electrical wires, each of said support members includes an opening communicating with said narrow part of said housing to provide a path for said wires.

7. An adjustable lamp fixture as claimed in claim 1 wherein said lamp housing is generally circular in cross section except for said narrow part.

8. An adjustable lamp fixture as claimed in claim 1 wherein the ends of said support members opposite said narrow part include fastening means for fastening said support members to said narrow part.

9. An adjustable lamp fixture as claimed in claim 1 wherein said base includes fastening means securing said fixture to an external support.

10. An adjustable lamp fixture comprising, a lamp housing having an internal chamber and including first pivot means, and a base supporting said housing including second pivot means cooperating with said first pivot means providing pivot structure enabling said housing to pivot relative to said base;

wherein said first pivot means includes a narrow portion at one end of said housing having opposing parallel generally annular faces with a substantial port through said narrow portion and at least one passageway communicating said port with an inside of said housing;

said base includes a pair of substantially mirror image hollow support members each of said support members includes a narrow substantially semi-cylindrical end part with parallel oppositely disposed annular faces, said support members being fastened together with one of said annular faces of one of said end parts associated with and in facing relationship with one of said annular faces of said housing;

a pair of cylindrical generally hat-shaped pivot members each having a flat circular portion associated with and in facing relationship with other of said annular faces of one of said end parts, each of said hat-shaped pivot members also including an upstanding cylindrical portion centered on said flat cylindrical portion;

a cut-out portion along each side of said housing adjoining said narrow portion;

a pair of elongated pivot arms each having a generally cylindrical bore through one end configured to surround one of said upstanding cylindrical portions of one of said pivot members and having opposite end of said pivot arm in said cut-out portion, and fastener means in said opposite end securing each said pivot arm to said housing.

11. An adjustable lamp fixture as claimed in claim 10 wherein said generally cylindrical bores are slightly tapered.

12. An adjustable lamp fixture as claimed in claim 10 wherein each end of each of said pivot arms is generally semi-cylindrical and each said cut-out portion includes a mating semi-cylindrical surface.

13. An adjustable lamp fixture as claimed in claim 10 wherein said base includes an opening at one end to receive electrical wires and each of said support members includes an opening communicating with said substantial port to permit unobstructed passage of said electric wires to said internal chamber.

14. An adjustable lamp fixture as claimed in claim 10 wherein said lamp housing is generally circular in cross section except for said narrow part.

15. An adjustable lamp fixture comprising a lamp housing, a base and pivot means connecting said base to said lamp housing;

said pivot means including a narrow part at one end of said lamp housing having parallel generally annular faces on opposite sides of said narrow part;

said base including spaced members straddling said narrow part, each of said spaced members having parallel annular faces on opposite sides thereof, one of said annular faces on each of said spaced members being associated with and in facing relationship with one of said generally annular faces of said narrow part;

a pair of pivot members each having a flat circular face associated with and in facing relationship with another of said parallel annular faces of each of said spaced members, each of said pivot members also including an upstanding cylindrical portion;

a cut out area along each side of said lamp housing adjoining said narrow part, a pair of elongated pivot arms each having a generally cylindrical bore through one end surrounding said upstanding cylindrical portion and having its opposite end positioned in said cut-out area, and fastener means in said opposite end securing said pivot arms to said lamp housing.

16. An adjustable lamp fixture as claimed in claim 16 wherein said spaced members each include a shallow cylindrical well receiving said pivot members.

17. An adjustable lamp fixture as claimed in claim 16 wherein each end of each of said pivot arms is semi-cylindrical and each said cut-out area includes a mating semi-cylindrical surface.

18. An adjustable lamp fixture as claimed in claim 17 wherein said base includes fastening means, said fastening means includes an opening to receive electrical wires, and each of said spaced members includes an opening communicating with said narrow portion of said housing to provide a path for said wires.

* * * * *